United States Patent [19]

Dorr

[11] 3,998,233

[45] Dec. 21, 1976

[54] BARRETTE WITH SWIVELED HINGE

[76] Inventor: Irene M. Dorr, 3819 Arbutus Ave., Baltimore, Md. 21207

[22] Filed: Sept. 22, 1975

[21] Appl. No.: 615,525

[52] U.S. Cl. ..... 132/48 A

[51] Int. Cl.[2] ..... A45D 8/24

[58] Field of Search ..... 132/46, 48, 40

[56] References Cited

UNITED STATES PATENTS

| | | | |
|---|---|---|---|
| 768,658 | 8/1904 | Dongille | 132/133 |
| 3,179,954 | 4/1965 | Weitzner | 132/46 R |
| 3,698,403 | 10/1972 | Morand | 132/46 R |

*Primary Examiner*—G.E. McNeill

*Attorney, Agent, or Firm*—Walter G. Finch

[57] ABSTRACT

The invention relates to a novel barrette structure useable in the manner of similar prior art structures and alternately capable of 360° rotation about the closed end thereof to facilitate styling of the hair.

5 Claims, 7 Drawing Figures

BARRETTE WITH SWIVELED HINGE

BACKGROUND AND SUMMARY OF THE INVENTION

The invention relates to hair styling devices of the type wherein toothed members are clamped in the wearer's hair to hold the hair in a desired manner.

The art of styling hair has likely been practiced since before time came to be recorded and history as we know was set down. During at least a portion of this time, various devices have come into use which clamp the hair into a confined disposition on the wearer's head. One such device is known as a barrette and is typically formed of two opposed rib-like members hinged for relative movement therebetween at a first juncture of two ends thereof and releasably fastenable at the juncture of the other two ends. One or both of the rib-like members can be toothed to better retain the hair between said members. This prior art structure proves satisfactory in use with some hair styles. However, certain styling procedures are difficult to accomplish with such prior art structures due to the need to comb relatively large portions of the hair from one side of the head to the other side thereof or to the dorso lateral line extending from the top of the cranium to the base of the neck. In such situations, one rib-like member of the prior art structures is "in the way" and renders such styling difficult if not impossible.

The present invention provides an improved barrette wherein the hinged end of the barrette is allowed to swivel in effectively a 360° plane of rotation, thereby allowing use of the improved barrette in the usual fashion as well as in styling situations for which the prior art structures have proven unsuitable. In particular, one of the rib-like members of the present barrette can be swivelled out facing relation to the other of the rib-like members comprising the barrette. Thus, hair can be combed easily into engagement with the one of the rib-like members without obstruction from the other of the members, the other of the rib-like members being then swivelled back into facing relation with the first-mentioned member and locked thereto to hold the hair.

It is therefore an object of the invention to provide a barrette for styling hair wherein the hinged end of the barrette can be swivelled to move one portion of the barrette out of facing relation to the other portion of the barrette, thereby to facilitate styling of the hair of the wearer.

It is a further object of the invention to provide a barrette which is easy to use both in a usual manner and in hair styling procedures not readily accomplishable by prior art barrette structures.

Other objects and advantages of the invention will become more readily apparent in light of the following detailed description of the preferred embodiment of the invention.

DESCRIPTION OF THE PREFERRED EMBODIMENTS

Figure 1:
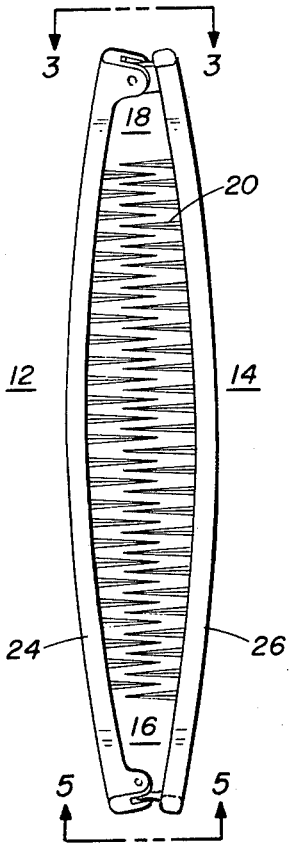
FIG. 1 is a perspective of the present barrette in a locked or closed position.
Figure 2:
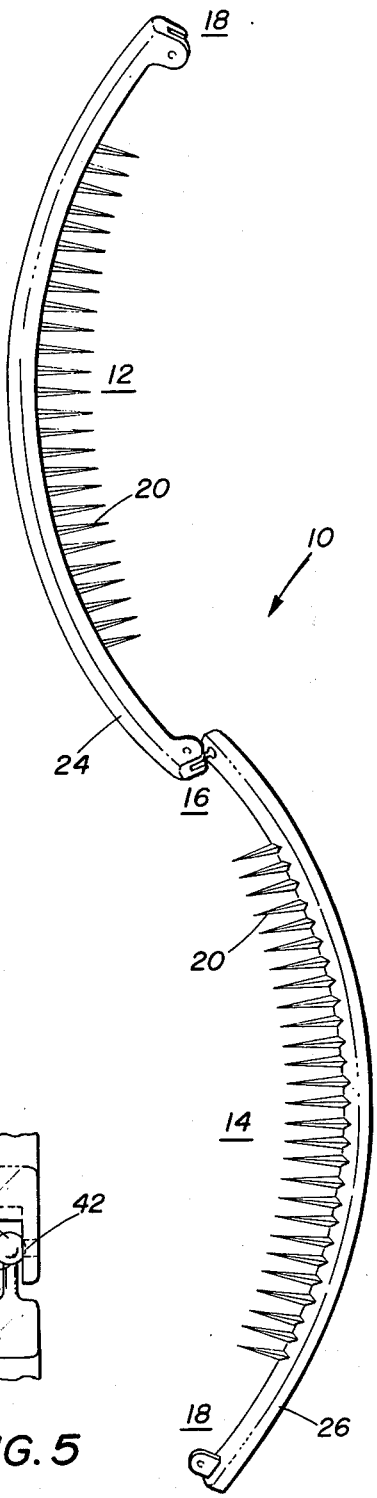
FIG. 2 is a perspective of the present barrette in an open position and wherein one half of the barrette structure has been swivelled out of facing relation to the other half thereof.
Figures 3, 4:
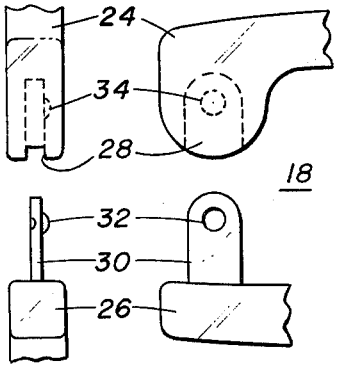
FIG. 3 is a detailed end view taken along line 3—3 of FIG. 1.
FIG. 4 is a detailed elevational view of the structure shown in FIG. 3.

Referring first to FIGS. 1 and 2, the invention is seen to comprise a barrette 10 formed of opposing comb sections 12 and 14 hinged together at a closed end by a swivel hinged mechanism shown generally at 16. The barrette 10 opens in a usual fashion at the opposite end 18. The barrette 10 is further formed with comb-like teeth 20 which extend from opposing rib-like members 24 and 26 comprising the section 12 and 14 respectively. As particularly seen in FIG. 1, the barrette 10 as seen in the closed position essentially functions in the same manner as certain prior art barrettes, i.e., the rib-like members 24 and 26 are locked in oppositely facing relation with the comb-like teeth 20 intermeshed, thereby to hold hair between the members 24 and 26. As seen in FIGS. 3 and 4, the member 24 has a slot 28 disposed in one end thereof, the member 26 having a locking member 30 formed on its oppositely facing end. The locking member 30 has a dimple 32 which snaps into a depression 34 formed in one wall of the slot 28 in said member 24. Thus, the member 24 is separable from the member 26 in a usual manner by "unsnapping" the locking member 30 (and dimple 32) from the slot 28 (and depression 34 into which the dimple 32 fits).

Figure 7:
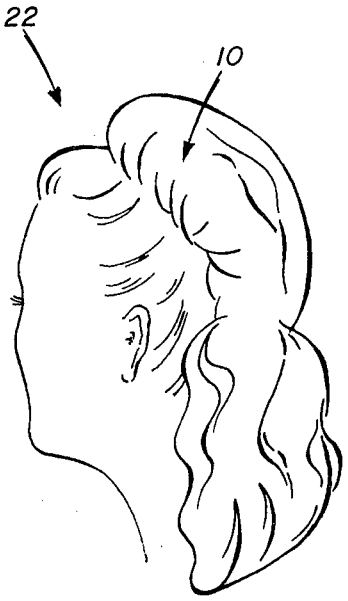
FIG. 7 is a perspective illustrating a typical hair style creatable through use of the present barrette.
Figures 5, 6:
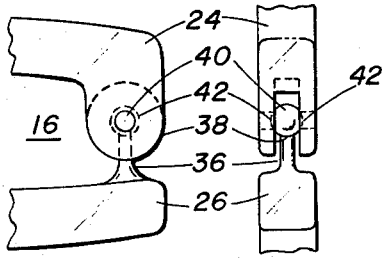
FIG. 5 is a detailed end view taken along line 5—5 of FIG. 1.
FIG. 6 is a detailed elevational view of the structure shown in FIG. 5.

Referring now to FIGS. 2, 5, and 6, the swivel hinged mechanism 16 not only allows the members 24 and 26 to "open" relative to each other in one plane, the mechanism 16 also allows either of the members 24 and 26 to swivel in a 360° arc of rotation relative to the other member. Thus, the barrette 10 can readily assume the position shown in FIG. 2, thereby allowing a user of the barrette 10 to comb hair into engagement with the teeth 20 of only one section 24 or 26 without being obstructed by the other section. The barrette 10 is first placed completely in the hair. After it is in the hair, the hair can be styled in numerous ways, one of which is shown in FIG. 7. The swivel hinged mechanism 16 is shown in FIGS. 5 and 6 to comprise a shaft 36 on the end of the member 26 and having a ball 38 mounted on the end of the shaft 36. The oppositely facing end of the member 24 has a slot 40 formed therein for receiving the shaft 36 and ball 38 therein, the slot 40 having aligned depressions 42 formed into the side walls defining the slot for seating the ball 38 at least partially thereinto. Thus, the ball 38 is freely rotatable within the seating depressions 42 to allow the members 24 and 26 to be moved relative to each other with virtually unlimited freedom of movement.

In use, the barrette 10 can be used in the fashion of a prior art barrette, i.e., the ends of the members 24 and 26 can be moved apart at the end 18 of the barrette to receive a portion of the wearers' hair therebetween. The barrette 10 is further useful when one of the members 24 and 26 is swivelled away from oppositely facing relation to the other member, thereby to allow use of the barrette to receive hair combed in a direction transverse to the longitudinal axis thereof without obstruction.

It is to be understood that the invention can be practiced other than as indicated specifically herein, the scope of the invention being defined by the appended claims.

What is claimed is:

1. A barrette comprising:

oppositely disposed rib-like members;

means releasably joining the members at the ends of the members; and, swivel means hingably joining the members at the opposite ends thereof from the first-mentioned means.

2. The barrette of claim 1 and further comprising teeth means on at least one of said rib-like members, said teeth means projecting inwardly of the barrette.

3. The barrette of claim 1 wherein the first-mentioned means comprise a locking member on one of the rib-like members, the locking member having a dimple on one side thereof, the other of the rib-like members having a slot formed therein and a depression formed in one wall defining said slot, the depression being aligned with and mating with the dimple on closure of the barrette.

4. The barrette of claim 1 wherein the swivel means comprise a shaft extending from an end of one of the rib-like members, the shaft terminating in a ball, the other of the rib-like members having a slot formed in an end thereof and having depressions formed in the walls of the slot for receiving the ball, thereby to allow the rib-like members to swivel relative to each other.

5. The barrette of claim 1 wherein the rib-like members are arcuately shaped.

* * * * *

132-279 SR
CCCA4 OR 3,998,233

REEXAMINATION CERTIFICATE (998th)

United States Patent [19]
Dorr
[11] B1 3,998,233
[45] Certificate Issued Jan. 24, 1989

[54] BARRETTE WITH SWIVELED HINGE

[76] Inventor: Irene M. Dorr, 3819 Arbutus Ave., Baltimore, Md. 21207

Reexamination Request:
No. 90/001,128, Nov. 14, 1986

Reexamination Certificate for:

| | |
|---|---|
| Patent No.: | 3,998,233 |
| Issued: | Dec. 21, 1976 |
| Appl. No.: | 615,525 |
| Filed: | Sep. 22, 1975 |

[51] Int. Cl.[4] ..... A45D 8/24
[52] U.S. Cl. ..... 132/48 A
[58] Field of Search ..... 132/46 R, 48 A, 41 R, 132/145, 40, 48 R

[56] References Cited

U.S. PATENT DOCUMENTS

| | | | |
|---|---|---|---|
| D. 154,205 | 6/1949 | Kovacs . | |
| D. 188,158 | 6/1960 | Dorr | D86/8 |
| D. 188,363 | 7/1960 | Dorr | D86/8 |
| 840,681 | 1/1907 | Becker . | |
| 989,656 | 4/1911 | Snow et al. | 132/145 |
| 1,741,073 | 12/1929 | Porter | 132/48 R X |
| 2,099,358 | 11/1937 | Witschi . | |
| 2,682,272 | 6/1954 | Hopkins et al. | 132/41 R |
| 2,708,941 | 5/1955 | Field, Sr. | 132/44 X |
| 2,977,960 | 4/1961 | Cattermole | 132/48 R |
| 3,860,014 | 1/1975 | Clifton . | |

FOREIGN PATENT DOCUMENTS

| | | | |
|---|---|---|---|
| 800390 | 8/1958 | United Kingdom | 132/46 R |

OTHER PUBLICATIONS

The News American, Weekly TV Magazine (Listings for Week beginning Aug. 25, 1974).

*Primary Examiner*—R. J. Apley

[57] ABSTRACT

The invention relates to a novel barrette structure useable in the manner of similar prior art structures and alternately capable of 360° rotation about the closed end thereof to facilitate styling of the hair.

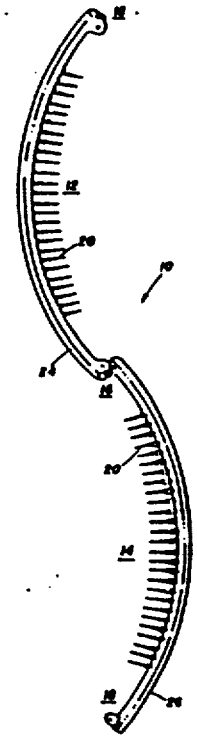

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 3 are cancelled.

Claims 2 and 5 are determined to be patentable as amended.

Claim 4, dependent on an amended claim, is determined to be patentable.

New claims 6 and 7 are added and determined to be patentable.

2. The barrette [of claim 1] *according to claim 4,* and further comprising teeth means on at least one of said rib-like members, said teeth means projecting inwardly of the barrette.

5. The barrette [of claim 1] *according to claim 4,* wherein the rib-like members are arcuately shaped.

*6. The barrette according to claim 2, wherein both said rib-like members include teeth facing the oppositely disposed rib-like member.*

*7. The barrette according to claim 2, wherein said joining means on said rib-like members comprises a locking member projecting from one of said rib-like members having a dimple on one side thereof, and a means including two facing walls defining a slot arranged on the other of said rib-like members, wherein one of said walls includes a depression into which said dimple is mated to fasten said rib-like members when the barrette is closed.*

* * * * *